US007648948B2

(12) United States Patent
Wu et al.

(10) Patent No.: US 7,648,948 B2
(45) Date of Patent: Jan. 19, 2010

(54) ADDITIVE SYSTEM FOR LUBRICANTS

(75) Inventors: Shi-Ming Wu, Dayton, NJ (US); William T. Sullivan, Brick, NJ (US); Ellen Bernice Brandes, Bound Brook, NJ (US)

(73) Assignee: ExxonMobil Chemical Patents Inc., Houston, TX (US)

( * ) Notice: Subject to any disclaimer, the term of this patent is extended or adjusted under 35 U.S.C. 154(b) by 678 days.

(21) Appl. No.: 11/101,761

(22) Filed: Apr. 8, 2005

(65) Prior Publication Data

US 2006/0229214 A1 Oct. 12, 2006

(51) Int. Cl.
*C10M 133/44* (2006.01)

(52) U.S. Cl. ..... 508/279

(58) Field of Classification Search ..... 508/279
See application file for complete search history.

(56) References Cited

U.S. PATENT DOCUMENTS

| | | | | |
|---|---|---|---|---|
| 4,511,481 | A | 4/1985 | Shim | 252/32.5 |
| 4,900,460 | A | 2/1990 | Cardis | 252/46.6 |
| 5,176,840 | A | 1/1993 | Campbell et al. | 252/49.6 |
| 5,225,093 | A | 7/1993 | Campbell et al. | 252/51.005 A |
| 5,328,619 | A | 7/1994 | Conary | 252/32.5 |
| 5,358,650 | A | 10/1994 | Srinivasan et al. | 252/45 |
| 5,451,332 | A | 9/1995 | Lawate | 252/32.7 E |
| 5,500,140 | A | 3/1996 | Hughes et al. | 252/46.7 |
| 5,547,596 | A | 8/1996 | Omiya | 508/188 |
| 5,571,445 | A | 11/1996 | Srinivasan et al. | 508/189 |
| 5,573,696 | A | 11/1996 | Hughes et al. | 508/224 |
| 5,691,283 | A | 11/1997 | Poat et al. | 508/186 |
| 5,750,478 | A | 5/1998 | Kim et al. | 508/331 |
| 5,756,429 | A | 5/1998 | Ichihashi | 508/192 |
| 5,759,965 | A * | 6/1998 | Sumiejski | 508/186 |
| 6,046,144 | A | 4/2000 | Karol et al. | 508/279 |
| 6,048,825 | A | 4/2000 | Markson et al. | 508/256 |
| 6,180,575 | B1 | 1/2001 | Nipe | 508/227 |
| 6,573,223 | B1 | 6/2003 | Vinci | 508/192 |
| 6,605,572 | B2 | 8/2003 | Carrick et al. | 508/198 |
| 2002/0086802 | A1 | 7/2002 | Cain | 508/185 |
| 2002/0147116 | A1 | 10/2002 | Carrick et al. | 508/198 |
| 2003/0176299 | A1 | 9/2003 | Guillemet et al. | 508/438 |
| 2004/0167041 | A1 * | 8/2004 | Arimoto | 508/272 |

FOREIGN PATENT DOCUMENTS

| | | |
|---|---|---|
| EP | 0 074 724 | 3/1983 |
| EP | 0 186 473 | 12/1984 |
| EP | 0 391 653 | 3/1994 |
| EP | 0 531 000 | 2/1997 |
| EP | O 531 585 | 11/1998 |
| EP | 0 519 760 | 2/1999 |
| EP | 0 450 208 | 12/1999 |
| EP | 1 422 287 | 5/2004 |
| JP | 7278142 | 10/1995 |
| JP | 9235581 | 9/1997 |
| JP | 10316987 | 12/1998 |
| RO | 118447 | 5/2003 |
| WO | WO 94/22990 | 10/1994 |
| WO | WO 95/29214 | 11/1995 |
| WO | WO 00/08119 | 2/2000 |
| WO | WO 01/66677 | 9/2001 |
| WO | WO 02/06930 | 1/2002 |
| WO | WO 03/104620 | 12/2003 |

* cited by examiner

*Primary Examiner*—Walter D Griffin
*Assistant Examiner*—Frank C Campanell
(74) *Attorney, Agent, or Firm*—Andrew B. Griffis; Nancy T. Krawczyk

(57) ABSTRACT

The invention relates to compositions suitable as additive packages for lubricants and other functional fluids, the composition comprising sulfur-containing extreme pressure components, phosphorus-containing anti-wear additives, a triazole-containing species. A preferred use is in industrial gear oils. In embodiments, enhance protection in the areas of bearing wear and micropitting are obtained.

28 Claims, No Drawings

ADDITIVE SYSTEM FOR LUBRICANTS

FIELD OF THE INVENTION

The invention relates to compositions suitable as additive systems for lubricants and other functional fluids, the composition comprising sulfur-containing extreme pressure (EP) components, phosphorus-containing anti-wear additives, and a triazole-containing species. The invention is also directed to lubricants and other functional fluids comprising the additive package of the invention, and to methods of making such compositions, systems, lubricants and other functional fluids. Lubricants so formulated are particularly useful as industrial gear oils (IGOs).

BACKGROUND OF THE INVENTION

Recent industrial gear lubricant requirements in the areas of bearing wear and micropitting have created a need for new lubricant compositions. In order to meet these new requirements, new additive packages suitable for blending with various base stocks are needed. It is desirable that these new requirements be met without detracting from the positive properties of current lubricant compositions with regard to oxidative and thermal stability, load carrying/antiwear performance, corrosion protection, seal compatibility, demulsibility, and the like.

Typically, additive packages are directed to specific end uses, such as industrial gear oils (IGO) or automotive driveline fluids. The demands of one particular end use typically will be different from another end use. For instance, many industrial gears require a lubricant that can function in the presence of large quantities of water, as would be found in steel mills, or in the highly contaminated environment of a mine or quarry, while sustaining high loads, speeds, and operating temperatures. In contrast, certain automotive driveline fluids, such as a manual transmission oils, typically operate in the absence of water. As another example, industrial gears can be as large as 10 meters in diameter and incorporate spur, bevel, helical, and spiral bevel designs in an endless variety of configurations, whereas driveline gears may be orders of magnitude smaller and carry heavier loads.

It would be advantageous to identify a composition suitable as an additive system for multiple diverse uses, but it is difficult enough to formulate a lubricant for certain end use given the rapid changes in marketing requirements.

By way of example, there are a variety of industrial gear oil approvals that oil marketers find advantageous to claim on the labels of their industrial gear fluids. In Europe, a key approval is DIN 51517-3. This particular industry specification was recently revised by Deutsches Institut fur Normung (DIN) to include a bearing wear test known as the FE-8 Test. This test was originated by FAG, a German bearing manufacturer, and is described in method DIN 51819-3.

Additionally, in the last decade, a wear phenomenon known as micropitting has been a growing concern. Flender, a German gear manufacturer, has incorporated the FVA-54 Micropitting test as part of their fluid approval program. Micropitting is a fatigue phenomenon, occurring on surface-hardened gears. It is characterized by extremely small pits, each approximately 10 microns deep. Micropitted metal has a frosted or gray appearance. Depending on how the fluid performs in the three-stage FVA-54 Micropitting Test, the oils are rated as "high", "medium" or "low" micropitting protection. Many oil marketers are currently requesting that industrial gear additive package suppliers demonstrate ample proof that their offering provides a high level of micropitting protection.

In addition to meeting these new requirements, industrial gear oils (IGOs) must maintain a specified level of performance in the typical bench tests that have been part of well-known industrial gear approvals like USS 224, AGMA 9005-D94, recently replaced by AGMA 9005-E02, Cincinnati Milacron, etc. The bench tests include, for example, Four Ball Wear (ASTM D2266), Four Ball EP (ASTM D2783), FZG Scuffing (DIN 51354-2), Timken (ASTM D2782), Copper Corrosion Protection (ASTM D130, ISO 2160), Oxidation Control (ASTM D2893, S-200), Rust Prevention (ASTM D665, ISO 7120), Static Seal Compatibility (DIN 53538-3), Demulsibility (ASTM D2711, ISO 6614, ASTM D1401), Foam Control (ASTM D892, ISO 6247), etc.

Given the enormous number of ingredients proposed for lubricant additive systems, it is a formidable task to find the right combination capable of meeting the number of new requirements desired in IGOs while maintaining traditional performance standards in other areas.

U.S. Pat. No. 4,511,481 discloses industrial lubricants stabilized with a triazole adduct of amine phosphates, providing oxidation stability, antiwear, and rust preventative performance.

U.S. Pat. No. 4,900,460 discloses sulfurized isobutylene reacted with dihydrocarbyl phosphates or phosphites as an extreme pressure and antiwear additive for lube oil compositions.

U.S. Pat. No. 5,225,093 is directed to a gear oil additive composition comprising (i) at least one oil-soluble succinimide and (ii) at least one carboxylic acid derivative composition produced by reacting at least one succinic acylating agent with a reactant selected from the group consisting of an amine and/or alcohol, wherein the succinic acylating agent has a substitutent group derived from polyalkene having a number average molecular weight of about 500 to about 100,000. These compositions contain on a weight basis 10-80 weight % of component (i) and 10-80 weight % of (ii) and the total of (i) and (ii) is 20-90 weight %. The patent is also directed to a major amount of a gear oil base stock containing the additive composition wherein the sulfur additives, phosphorus additives, and nitrogen additives are in proportions such that the composition possesses a weight ratio of sulfur to phosphorus in the range of about 5:1 to about 40:1, and a weight ratio of nitrogen to phosphorus in the range of about 0.05:1 to about 2:1. See also U.S. Pat. No. 5,176,840.

U.S. Pat. No. 5,328,619 is directed to an additive concentrate formed from a combination of (i) an oil-soluble amine salt of a dihydrocarbyl monothiophosphoric acid and (ii) at least one oil-soluble active sulfur-containing antiwear/extreme pressure agent, and (iii) one or more oil-soluble acidic organic additives, at least one of which is a hydrocarbyl phosphoric acid or a carboxylic acid. The concentrate contains one or more oil-soluble primary amines in an amount to give a pH in the range of about 6.0 to 7.0. See also EP 519 760 B1.

U.S. Pat. No. 5,358,650 is directed to a gear oil comprising a dialkyl ester of a dicarboxylic acid and PAO combination for the base oil and additive components, the latter comprising an organic sulfur-containing antiwear and/or extreme pressure agent, an organic phosphorus-containing antiwear and/or extreme pressure agent, a copper corrosion inhibitor, a rust inhibitor, a foam inhibitor, and an ashless dispersant. The gear oil has a boron content of about 0.0025 to about 0.07 wt. % and an S:P weight ratio of 8:1 to 35:1. See also U.S. Pat. No. 5,571,445, WO 1994/22990, U.S. Pat. No. 5,500,140 teaches an oil soluble phosphorus- and nitrogen-containing composition having limited slip properties formed by reacting an O,O-dihydrocarbyl phosphorodithioic acid with an epoxide to form a product which is then reacted with phosphorus pentoxide to produce an acid phosphate intermediate which is then neutralized with an amine. The additive is considered by the patentee to be useful in lubricating oils to inhibit limited slip axle or differential noise. A composition comprising (a) an oil-soluble sulfur-containing antiwear/extreme pressure agent, and (b) a phosphorus- and nitrogen-containing composition such that the weight ratio of sulfur as component (a) to phosphorus as component (b) is in the range of about 1:1 to about 20:1. See also U.S. Pat. No. 5,573,696.

U.S. Pat. No. 5,547,596 is directed to a lubricant composition said to reduce the "chattering" of a limited slip differential of a car, obtained by adding a phosphate amine salt and a borated ashless dispersant to a base oil comprising at least one of a mineral oil and a synthetic oil, the composition having a nitrogen:phosphorus ratio of 0.5 to 1.0, and a nitrogen:boron ratio of 4 to 10, the phosphorus content being in the range of 0.15 to 0.40 wt %, the nitrogen content being in the range of 0.08 to 0.30 wt %, and the boron content being in the range of 0.01 to 0.04 wt %.

U.S. Pat. No. 5,691,283 teaches a lubricant for synchronized transmission or differential axle having a viscosity grade level of from SAE 75W-90 to SAE 85W-140 comprising a base oil containing at least (i) a Mannich base ashless dispersant; (ii) metal-free, sulfur-containing antiwear and/or extreme pressure agent; (iii) metal-free, phosphorus-containing and nitrogen-containing antiwear and/or extreme pressure agent, and (iv) overbased alkali or alkaline earth metal carboxylate, sulfonate or sulfurized phenate.

U.S. Pat. No. 5,756,429 discloses a lubricating oil composition comprising a base oil and sulfur, phosphorus, and nitrogen additives such that the ratio 100N/(S+P) is in the range of 4 to 10 by weight.

U.S. Pat. No. 6,046,144 discloses zinc-free antiwear hydraulic fluids and gear lubricating oils comprising thiophosphate antiwear agents, corrosion and rust inhibitors and an antioxidant composition comprising amine salts of alkyl phosphates and ethylenediamine, ammonium, or metal salts of alkylarylsulfonates.

U.S. Pat. No. 6,048,825 is directed to a lubricant composition comprising a synthetic base stock having a viscosity of 5.0 to 10.0 cSt at 100° C., an antioxidant selected from aromatic amines and hindered phenolics, at least one neutral phosphate, at least one dicarboxylic acid, at least one straight and/or branched chain monocarboxylic acid, and at least one triazole derivative. See also WO 1995/29214.

U.S. Pat. No. 6,180,575 discloses a lubricating oil having additives comprising an adduct of a substituted triazole with an amine phosphate in order to balance anti-wear and anti-rust properties. See also WO 2000/08119.

U.S. Pat. No. 6,605,572 is directed to lubricating oils with boron-containing compounds. The composition further contains sulfur and phosphorus such that the ratio of S to B to P is represented by the formula: $S^1+5B^1+3P^1>0.35$, where $S^1$ is the weight percent of sulfur in the composition, $B^1$ is the weight percent of boron in the composition, and $P^1$ is the weight percent of phosphorus in the composition. Furthermore, the composition contains "relatively low levels" of sulfur (0.01-0.25 wt %), and "relatively low levels" of phosphorus (up to 0.08 wt. %). See also WO 02/06930 A2 and U.S. Patent Application 2002/0147116 A1.

U.S. Patent Application 2003/0176299 A1 teaches a multifunctional lubricant comprising (a) at least one phosphoric ester of a C10 to C20 linear alkyl or alkenyl radical or a salt of such an ester, and (b) a polysulfide of general formula $R—S_y—R$, where y is from 2 to 8 and R is a C4-C18 tert-alkyl radical, wherein the ratio of a:b is between 0.01:1 and 1:1. See also WO 200166677.

WO 03/104620 A2 is directed to the problem of providing adequate engine lubrication and at the same time reduce catalyst contamination due to the use of phosphorus-containing compounds, where the phosphorus concentration is up to about 0.12% by weight, acting as extreme pressure and antiwear additives in engine oils. A composition is provided characterized by a nitrogen to phosphorus ratio of 0.3:1 to 4:1.

EP 1422287 A1 is directed to a lubricating composition containing 0.01-0.06 wt % phosphorus, 0-0.1 wt % sulfur derived from a base oil, and 0.01-0.15 wt % of sulfur derived from sulfur-containing additives, and characterized by having a P:S ratio of 1:(0.2-20). See also WO 03/020858 A1.

EP 391 653 B1 teaches the addition of a weak acid and an amine to sulfur-containing gear oils. The lubricating compositions comprise a lubricant, 1.7 to 20 wt % of a sulfur-containing extreme pressure (EP) or anti-wear agent, 0.1 to 10 wt % of a weak acid, and from 0.05 to 10 wt % of an amine. The weak acid is present in the amount of from 0.2 to 2 equivalents per equivalent of the amine, and the molar ratio of the sulfur in said EP/antiwear agent to the nitrogen in said amine is from 40:1 to 5:1.

EP 0 531 000 B1 is directed to lubricating oils and functional fluids formulated to meet certain American Petroleum Institute (API) requirements. The composition comprises a component (b) comprising sulfur at a level of at least 20 mass % and a component (a) comprising phosphorus, proportioned so that the mass ratio of sulfur in (b) to phosphorus in (a) is in the range of 8:1 to 30:1, further characterized as a finished lubricating oil having at least 0.5 wt. % sulfur as component (b).

EP 0 450 208 B1 teaches a lubricant comprising (i) one or more highly-active sulfur-containing extreme pressure or antiwear agents, (ii) one or more amines, (iii) one or more weak acids, wherein the mole percentage of sulfur in (i) to amino nitrogen in (ii) is 100:1 to 5:1 and is further characterized by having 0.2 to 2 equivalents of acid (iii) per equivalent of amine nitrogen in (ii).

EP 0 531 585 B1 discloses an oil-soluble additive concentrate comprising (a) a boronated Mannich base ashless dispersant; (b) a metal-free sulfur-containing antiwear and/or extreme pressure agent; (c) a metal-free phosphorus-containing antiwear and/or extreme pressure agent; and (d) an oil-soluble amine salt of an carboxylic acid, where the weight ratio of N in (a) to S in (b) is 0.00005:1 to 0.5:1 and/or the weight ratio of N in (a) to P in (c) is 0.005:1 to 5:1.

EP 186473 is drawn to an additive compound for lubricants and fuels containing amine linkages from mono- and polycarboxylic acids in the same molecule, produced by reacting a fatty carboxylic acid and at least one alkenyl- or alkylsuccinic acid and anhydride with at least one polyamine.

JP 7278142 (Application No. JP19940087388) discloses an additive having an olefinic polymer chain and obtained by reacting a dicarboxylic acid anhydride with a higher fatty acid and a polyalkylene polyamine.

JP 9235581 (Application No. JP19960302422) discloses a composition excellent in heat resistance, oxidation resistance, and abrasion resistance comprising a polyphenylene thioether, an acidic phosphate ester amine salt and a phosphate ester in a synthetic lubricating base oil.

JP 10316987 discloses a gear oil comprising a base oil, 0.05-8 wt. % sulfur compounds selected from hydrocarbon sulfides, sulfurized terpenes and/or sulfurized fats, and 0.1-6 wt. % phosphorus compounds selected from higher alkanol acid phosphates and/or their alkylamine salts.

Romanian Patent 118447 discloses an additive for heavy loading including succinimide and a dialkyl phosphate such as a sulfurized isobutene.

Other references of interest include U.S. Pat. No. 5,451,332 and EP 0 074 724.

The present inventors have surprisingly discovered a composition suitable as an additive system for diverse uses, such as for IGOs and for automotive driveline fluids. In preferred embodiments, the additive system may be combined with suitable basestocks to provide lubricants that meet the most recent industrial requirements for IGOs, without detracting from the positive attributes of currently available commercial products.

SUMMARY OF THE INVENTION

The composition of the invention comprises a combination of at least one sulfur-containing extreme pressure (EP) ingredient, at least one antiwear ingredient selected from phosphorus-containing compounds, at least one triazole-containing species, and optionally at least one other nitrogen-containing compound, said composition further characterized by having a mass ratio of sulfur to phosphorus of less than or equal to 10:1, more preferably less than or equal to 8:1 and still more preferably less than or equal to 7:1; a mass ratio of phosphorus to nitrogen of greater than or equal to 2:1, more preferably greater than or equal to 2.5:1; and a mass ratio of sulfur to triazole of less than or equal to 150:1.

The invention is also directed to an additive system comprising the composition according to the invention, that when blended with suitable basestocks at the appropriate treat rate will provide improved lubricant compositions for both industrial and automotive gear applications.

The invention is also directed, in preferred embodiments, to a fully formulated industrial gear oil (IGO) comprising at least one basestock selected from API Group I through V basestocks and an additive system comprising the composition according to the invention.

The invention is still further directed to a method of making an additive system and also a method of making a fully formulated lubricant.

It is an object of the invention to provide improvements for lubricants in the area of bearing wear and micropitting.

It is still another object of the invention to provide an additive system suitable for blending with appropriate basestocks at the appropriate treat rate to provide lubricant compositions particularly suitable as industrial gear oils (IGOs).

These and other embodiments, objects, features, and advantages will become apparent as reference is made to the following detailed description, preferred embodiments, examples, and appended claims.

DETAILED DESCRIPTION

According to the invention, a composition is provided comprising a combination of at least one extreme pressure ingredient selected from sulfur-containing extreme pressure additive, at least one antiwear ingredient selected from phosphorus-containing compounds, a species containing a triazole moiety, e.g., a triazole or a triazole derivative, and in a preferred embodiment at least one other nitrogen-containing compound. The "at least one other nitrogen-containing compound" is a compound other than a compound containing a triazole moiety. The composition is further characterized by having a weight ratio of sulfur to phosphorus of less than 10:1, a mass ratio of nitrogen to phosphorus of less than 2:1 and a mass ratio of sulfur to triazole derivative of less than or equal to 150:1. Additional embodiments are described herein below.

In preferred embodiments, the ingredients are selected from the following materials.

Extreme Pressure Agents

Extreme pressure (EP) agents useful in the composition according to the invention include known sulfur-containing and boron-containing EP agents. Sulfur-containing EP agents are preferred.

Sulfurized olefins are known per se to be useful to provide protection against high pressure, metal-to-metal contacts in industrial and automotive gear oils. However, the presence of sulfurized olefins for this purpose must be balanced against the drawbacks which may include compromised seal integrity, yellow metal corrosion, and increased bearing wear and micropitting.

There is no particular restriction on the sulfur-containing extreme pressure additive that can be used in the additive package of the invention. Sulfur-containing components useful in this regard include sulfurized olefins, dialkyl polysulfides, diarylpolysulfides, sulfurized fats and oils, sulfurized fatty acid esters, trithiones, sulfurized oligomers of C2-C8 monoolefins, thiophosphoric acid compounds, sulfurized terpenes, thiocarbamate compounds, thiocarbonate compounds, sulfoxides, and thiolsulfinates. Mixtures of sulfur-containing EP components may be used.

The preferred sulfur-containing EP components are selected from sulfurized oligomers of C2-C8 monoolefins, olefin sulfides and dialkyl and diaryl polysulfides.

A very large number of sulfurized olefins suitable for use as extreme pressure agents are detailed in the prior art. See, for instance, U.S. Pat. No. 6,844,300 and references cited therein.

The more preferred extreme pressure agents are oligomeric olefin sulfides and dialkyl polysulfides. Oligomeric olefin sulfides are prepared via the reaction of sulfuryl monochloride with an olefin, e.g. isobutylene, to create an oligomeric olefin sulfide compound. One drawback to the use of some of these materials is the residual chlorine which some processes leave behind, but this can be reduced by various treatments. Numerous patents describe sulfurized olefins suitable for use in the present invention, such as U.S. Pat. Nos. 2,249,312; 2,708,199; 3,471,404; 4,204,969; 4,563,302; 4,954,274; and 4,966,720 and European Patent No. 737,674A2 and British Patent No. 1,308,894.

Dialkyl polysulfides are prepared via a high pressure sulfurization procedure such as described in U.S. Pat. Nos. 4,119,550; 4,119,549; 4,344,854; 5,135,670; and 5,338,468. These may be prepared, for instance, by the reaction of sulfur, an olefin, and hydrogen sulfide, which may be provided in situ or added from an external source. The preferred method for the purpose of providing an extreme pressure agent for use in the additive package of the present invention involves generating the hydrogen sulfide in situ. In a more preferred embodiment, hydrogen sulfide is formed in the reactor from sodium hydrogen sulfide and consumed within the reactor.

In a more preferred embodiment, the high pressure sulfurized olefin is prepared by reacting an olefin, preferably isobutylene, with molten sulfur in predetermined quantities in the presence of aqueous sodium hydrogen sulfide under high pressure conditions. Commercially available high pressure sulfurized isobutylene (HPSIB) include Mobilad™ C-170 and Mobilad™ C-175, commercially available from ExxonMobil Chemical Company. The synthesis of these preferred HPSIBs have been described in the prior art, such as U.S. Pat.

No. 5,135,670 and WO 92/03524, and elsewhere. Typically, the higher the percentage of sulfur in the HPSIB, the more aggressive is the agent regarding EP but also regarding corrosion problems and in some cases seal integrity. The negative effects may be mitigated by additives, e.g., more and/or different copper passivators.

While not critical to the characterization of the present invention, in a preferred embodiment the weight percent of sulfur in any form in the additive package according to the invention is about 5-50 wt %, more preferably 10-30 wt %. What is critical is the weight ratio of sulfur to phosphorus in the composition according to the invention, as set forth elsewhere.

Boron-containing EP agents are also per se known in the art. However, boron-containing EP agents may have deficiencies in the area of hydrolytic stability, so if a gear box is exposed to water, which is possible in an IGO situation, the boron-containing EP agents can hydrolyze and lose their effectiveness as EP components. However, for certain uses it is possible that boron-containing EP additives may be adequate, such as if there is no water present. Use of boron-containing EP agents alone or with sulfur-containing EP agents is a contemplated aspect of the invention. However, in an embodiment, the composition according to the present invention does not use an extreme pressure ingredient containing boron.

Phosphorus-Containing Antiwear Agents

There is no particular restriction on the type of phosphorus-containing antiwear agents used. Oil soluble antiwear and/or extreme pressure agents that are typically used in industrial gear oils are for the most part partially or fully esterified acids of phosphorus. All of these are suitable for additive systems according to the invention. Preferred antiwear agents include the following: acid phosphates, hydrogen phosphites, phosphites, phosphates, phosphonates, phosphinates, and phosphoroamidates. Sulfur analogs of the aforementioned species may also be used, bearing in mind the various critical elemental ratios critical to the invention, set forth elsewhere herein.

Preferred antiwear agents include mono, di and trihydrocarbyl phosphites; mono, di, and trihydrocarbyl phosphates; mono, di, and trihydrocarbyl mono, di, tri, tetrathiophosphates; mono, di, trihydrocarbyl mono, di, tri, tetrathiophosphites; various hydrocarbyl phosphonates and thiophosphonates; various hydrocarbyl phosphonites and thiophosphonites, and the like. Specific examples include tricresyl phosphate, tributylphosphite, triphenyl phosphite, 2-ethylhexyl phosphate, diisobutylhydrogen phosphite, diisopropyl dithiophosphate, diphenyl phosphate, etc. All of the amine salts that can be formed with these materials are also included and the types of amines that can be used are described in a later section. The preferred embodiments are the dialkyl and diaryl phosphates and their amine salts. Also preferred are aryl phosphates, such as the commercially available Irgalube™ 349 from Ciba. Particularly preferred alkyl acid phosphates include di- and/or mono-2-ethylhexyl phosphoric acid.

While not critical to the characterization of the present invention, in a preferred embodiment the level of phosphorus in the composition according to the invention is about 1-5 wt %, more preferably 2-4 wt %. Again, what is critical is the mass ratio of sulfur to phosphorus, as well as the other mass ratios discussed in detail below.

Triazole-Containing Species

A key ingredient and source of nitrogen in the composition according to the invention is a triazole species or derivative thereof. While the exact amount used is not critical (again, provided the appropriate ratios of S, P, N, and triazole set forth elsewhere herein are met) an effective amount should be used. This may be determined by one of ordinary skill in the art in possession of the present disclosure.

Triazoles, e.g., 1,2,4-triazole, 1,2,3-triazoles, and their derivatives have been found to be important for reducing bearing wear in industrial oils and preventing corrosion manual transmission oils. Since triazole itself is difficult to solubilize in oil or in an additive mix, it is advantageously derivatized. The derivatives provide a means for making the triazole group more soluble in oil while retaining its corrosion and wear reducing properties. Some specific examples of derivatives include benzotriazole, tolytriazole, octyltriazole, decyltriazole, dodecyltriazole, 2-mercaptobenzotriazole. Alkyl and aryl derivatives of triazoles are preferred. Most preferred is the tolyltriazole, e.g. Cobratec™ TT100, and benzotriazole, e.g. Cobratec™ 99. Any of these triazoles may also be present as a carboxylic acid salt, e.g the salt of a fatty acid, like oleic acid or the salt of polybutenyl succinic acid. Amide derivatives are also envisioned. Additionally, the triazole can also be present in the form of a salt of one of the phosphorus acid species described above. A particularly preferred embodiment of the invention is the complex of the triazole derivative with an alkyl or aryl acid phosphate.

Nitrogen-Containing Compounds

While it is at least theoretically possible that no other nitrogen-containing species need be used in the additive system according to the invention most preferred embodiments will contain at least one other nitrogen-containing component, typically selected from rust inhibitors, dispersants, metal passivators (e.g., copper passivators), antioxidants, and the like. Any nitrogen-containing additive used will contribute to the P:N mass ratio critical to the invention and discussed more fully below. The "at least one other nitrogen-containing" as used herein means something different than a triazole-containing species. Advantageously the at least one other nitrogen-containing component will be selected from the following (and includes mixture thereof).

Rust Inhibitors

Rust inhibitors, a preferred source of nitrogen for this invention, are any oil-soluble basic amine or combinations of amines. The amines can be primary, secondary, tertiary, acyclic or cyclic, mono or polyamines. They can also be heterocyclic. The amine containing components can also contain other substituents, e.g. ether linkages or hydroxyl moieties. The preferred amines are generally aliphatic in nature. Some specific examples include: octylamine, decylamine, C10, C12, C14 and C16 tertiary alkyl primary amines (or combinations thereof), laurylamine, hexadecylamine, heptadecylamine, octadecylamine, decenylamine, dodecenylamine, palmitoylamine, oleylamine, linoleylamine, di-isoamylamine, di-octylamine, di-(2-ethylhexyl)amine, dilaurylamine, cyclohexylamine, 1,2-propylene amine, 1,3-propylenediamine, diethylene triamine, triethylene tetraamine, ethanolamine, triethanolamine, trioctylamine, pyridine, morpholine, 2-methylpiperazine, 1,2-bis(N-piperazinyl-ethane), 1,2-diamine, tetraminooctadecene, triaminooctadecene, N-hexylaniline and the like. They may also be triazole or triazole derivatives, which are described elsewhere as a necessary ingredient in the composition according to the present invention.

The most preferred amines for this invention to serve as rust inhibitors are oil-soluble aliphatic amines in which the aliphatic group is a tertiary alkyl group. Primene™ 81R and Primene™ JMT amines are commercially available [from Rohmax] amines that fall into this category. These may be used in addition to the triazole and/or triazole derivatives, e.g. tolyltriazole, which are a critical requirement of the invention, as discussed above.

In the additive system of the invention, amines will typically combine with the acid phosphates to form salts (the extent to which is controlled by stoichiometry as well as other factors), which are effective as antirust and antiwear agents. Thus, as will be recognized by one of ordinary skill in the art in possession of the present disclosure, the composition of the invention is set forth by way of a recipe, and that more or less of the actual "phosphate", "amine", etc. will be identifiable as a discrete entity, depending on stoichiometry, temperature, and whether or not the species are present as an additive package per se or in the final formulated basestock, and so forth. Thus, for instance, the salts of the phosphates and amines may be formed prior to addition to the additive package or they may be formed in situ after the acid phosphate and amine is added to the package.

Amides, imides, and imidazolines, oxazolidones, and other related nitrogen-containing species may also be included as optional sources of nitrogen in the additive system of the invention. These species often serve as rust inhibitors, friction modifiers, and the like. Some examples of these include the reaction products of dodecenylsuccinic anhydride (DDSA) and tetraethylene pentamine, the reaction products of oleic acid and tetraethylene pentamine, the reaction products of diethylene triamine and DDSA, the reaction products of triethanolamine and nonanoic acid and the like.

Dispersants

A preferred but optional source of the nitrogen is at least one dispersant and/or cleanliness agent. Dispersants serve inter alia to keep sludge and varnish particles from coating on the gear surfaces. Numerous such agents are per se known in the art. There are no particular restrictions on the type to be used. They may be used singly or in combinations. Typical examples of nitrogen-containing dispersants include alkylsuccinimides, alkenylsuccinimides, boron-containing alkylsuccinimides, boron-containing alkenylsuccinimides, benzylamines compounds (Mannich bases), polybutenylamines, succinic acid ester compounds, and the like.

In preferred embodiment, nitrogen-containing dispersants are selected from are alkylsuccinimides, alkenylsuccinimides, and the boron-containing analog of both of these. The especially preferred ashless dispersants for use in this invention are the products of reaction of a polyethylene polyamine, e.g. triethylene tetraamine pentaamine, with a hydrocarbon-substituted anhydride made by the reaction of a polyolefin, preferably having a molecular weight of about 700-1400 and especially 800-1200 (it is not particularly important whether this is number average or weight average molecular weight) with an unsaturated polycarboxylic acid or anhydride, e.g. maleic anhydride. The ashless dispersants can be boronated to form ashless boron-containing dispersants using suitable boron-containing compounds: boron acids, boron oxides, boron esters, and amine or ammonium salts of boron acids.

Other Nitrogen-Containing Additives

Antioxidants containing aromatic nitrogen can also be employed and will contribute to the level of nitrogen. Antioxidants are used to protect the composition and reduce the decomposition by oxygen, especially at elevated temperatures. Typical antioxidants that contain nitrogen include secondary aromatic amine antioxidants. Specific examples include diphenylamines, alkylated diphenylamines, phenyl-alpha-napthylamines, and their derivatives. It is understood that the nitrogen in these species will contribute to the phosphorus to nitrogen mass ratio.

Another preferred but still optional ingredient that contains nitrogen is the class of additives known as metal passivators, e.g., copper passivators. These comprise the class of compounds which include thiazoles, triazoles, discussed earlier, and thiadizoles. Specific examples of the thiazoles and thiadiazoles include 2-mercapto-1,3,4-thiadiazole, 2-mercapto-5-hydrocarbylthio-1,3,4-thiadiazoles, 2-mercapto-5-hydrocarbyldithio-1,3,4-thiadiazoles, 2,5-bis-(hydrocarbylthio)-1,3,4-thiadiazoles, and 2,5-bis-(hydrocarbyldithio)-1,3,4-thiadiazoles. The preferred compounds are the 1,3,4-thiadiazoles, especially the 2-hydrocarbyldithio-5-mercapto-1,3,4-dithiadiazoles and the 2,5-bis(hydrocarbyldithio)-1,3,4-thiadazole. Several of these are commercially available, e.g. Afton Hitec™ 4313 and Mobilad™ C-610. Other suitable inhibitors of copper corrosion include imidazolines, described above, and the like.

Numerous other nitrogen-containing additives useful for an additive system of the invention, such as friction modifiers, chromophores, demulsifiers, defoamants, tackifiers, deodorants, seal swell agents, and the like, will be apparent to one of ordinary skill in the art in possession of the present disclosure. These species, if present, will of course also contribute to (and are to be considered in) the critical P:N ratio set forth herein. Similarly, it is to be understood that all other species in the final additive system, whether S-, P-, or N-containing, will contribute to the ratios set forth herein as critical. However, contributions to the critical ratios provided by the basestock are not considered in these ratios. Typically, contributions to P- or N-containing species in basestocks are negligible relative to the contributions provided by the additive system. However, S-containing impurities in basestocks maybe of a level comparative to those provided by the additive system of the invention, and thus, again, are not to be considered in the ratios set forth herein.

Mass Ratios of S, P, N, and Triazole-Containing Species

The present inventors have found the mass ratio of sulfur to phosphorus, phosphorus to nitrogen, and sulfur to triazole-containing species to be a critical aspects of the present invention. The additive system of the invention is characterized by having a mass ratio of sulfur to phosphorus of less than 10:1, a mass ratio of phosphorus to nitrogen of greater than 2:1, and a mass ratio of sulfur to triazole derivative of at least 150:1.

In more preferable embodiments, the mass ratio of sulfur to phosphorus is less than or equal to 8:1, and in certain even more preferable embodiments the mass ratio is less than or equal to 7:1. While it is not critical to the invention to characterize a lower limit, provided there is an effective amount of at least one sulfur-containing EP agent and an effective amount of at least one phosphorus-containing antiwear agent, in an embodiment a lower mass ratio limit of S:P is about 1:1.

With respect to the phosphorus to nitrogen mass ratio, in more preferable embodiments, the mass ratio is greater than or equal to 2.5:1, and in certain even more preferable embodiments, the mass ratio is greater than or equal to 3:1. While it is not critical to the invention to characterize an upper limit, provided there is an effective amount phosphorus-containing antiwear agent, an effective amount of at least one nitrogen-containing compound, and an effective amount of triazole-containing ingredient, without any of the ingredients being present in an amount so great that the objects of the invention cannot be met, in embodiments an upper limit can be characterized as no greater than 5:1.

Regarding the mass ratio of sulfur to triazole derivative it is 150:1 or less and in preferred embodiments it is 110:1 or less and in another preferred embodiment, it is 75:1 or less. While not critical to the description, provided effective amounts of the required materials set forth herein are present, typically the lower limit of sulfur to triazole derivative will be about 10:1.

It is believed by the inventors that the combination of the aforementioned ratios in a composition according to the invention will, when provided in a fully formulated oil comprising, in addition to an effective amount of the composition, one or more basestocks, provide gear lubricants that can meet the recent industrial gear requirements.

Without wishing to be bound by theory, the reduced sulfur to phosphorus ratio (compared with presently available commercial additive packages), along with the increased P:N ratio (compared with presently available commercial additive packages), and the presence of triazole or one of its derivatives, provide the desired level of bearing wear and micropitting protection, while not interfering, at least with respect to one or more of the objects of the invention, with other key performance areas of an IGO.

Other ingredients, such as defoamants, demulsifiers, friction modifiers, seal swell agents, pour point depressants, diluents, thickeners, chromophores, tackifiers, and the like, may be present to provide the required oil attributes, provided the aforementioned mass ratios for S:P, P:N, and S to triazole-containing species are met.

Typically, defoamants include silicones and organic polymers such as acrylate polymers. Various antifoam agents are described in *Foam Control Agents* by H. T. Kerner (Noyes Data Corporation, 1976). Demulsifers are typically ethylene oxide propylene oxide copolymers, like BASF's Pluronic™ series, but they may also be esters and anhydrides and other chemical moieties. Friction modifiers are varied in chemical nature. Common ones include fatty amides and acids, but there are many others. These optional ingredients may be part of an additive package comprising the composition according to the invention, or they may be added separately to the basestock in the final fully formulated lubricant or other functional fluid, or a combination thereof. Again, the effective amount of these optional ingredients may be determined by one of ordinary skill in the art in possession of the present disclosure. It is conceivable that some of these additives will contribute to the level of S, P, and N in oil and therefore will alter the key ratios.

While the composition, including necessary ingredients and optional ingredients, has been set forth in detail above, it will be understood by one of ordinary skill in the art that typically some or all of the desired ingredients will be blended into an additive package, which the oil formulators will add to a basestock or other fluids, e.g., carrier, hydraulic fluid, solvent, etc. Typically for an additive package, a diluent may also be used. Typical diluents will be selected from the same material as the basestock or base oil, but it may be different. Thus, in preferred embodiments the diluent will be selected from one or more of the basestocks described further below.

The additives may be combined in whole or in part into an additive package, or they may be added separately to the final lubricant composition or other functional fluid. The blending operations in any of these cases do not need to be complex. They may involve simply mixing together in suitable proportions all the appropriate components. Those who are skilled in the art would be familiar with suitable procedures and for formulating and blending additive concentrates and lubricant compositions. Generally speaking, the order of addition is not critical unless in order to control exotherms it is necessary to alter the order, which may be determined by one of skill in the art without more than routine experimentation. Without wishing to be overly pedantic, agitation with a mechanical stirrer is typically desirable to facilitate blending. Some practicioners may wish to apply heat while blending. Generally, heating the blend between 40° and 100° C. will be sufficient. Naturally, the temperatures should be chosen so as not to cause any unwanted chemical reactions or thermal degradation. Blending under an inert atmosphere may be beneficial. Blending the finished lubricants is equally as straightforward.

However, as previously alluded to, the additive "system" of the invention is set forth in the nature of a recipe and the presence or absence of any of the particular ingredients set forth will depend on the order of addition, among other factors. Thus, the additive system of the invention may also be said to be a composition obtainable by adding together a sulfur-containing EP component, a phosphorus-containing antiwear additive, a triazole-containing corrosion inhibitor, and, in preferred embodiments, at least one additional nitrogen-containing component, or it may be said to be a composition made by adding together the aforementioned ingredients, or it may be said to be the contact product of the aforementioned ingredients.

Base Oils

The additive package of the invention is typically added to one or more base oils. Compositions comprising the additive system according to the invention and a base oil are also a contemplated embodiment of the present invention. Fluids that can meet the criteria of base oil for lubricant and functional fluids are varied. They may fall into any of the well-known American Petroleum Institute (API) categories of Group I through Group V. The API defines Group I stocks as solvent-refined mineral oils. Group I stocks contain the most unsaturates and sulfur and have the lowest viscosity indices. Group I defines the bottom tier of lubricant performance. Group II and III stocks are high viscosity index and very high viscosity index base stocks, respectively. The Group III oils contain fewer unsaturates and sulfur than the Group II oils. With regard to certain characteristics, both Group II and Group III oils perform better than Group I oils, particularly in the area of thermal and oxidative stability.

Group IV stocks consist of polyalphaolefins, which are produced via the catalytic oligomerization of linear alphaolefins (LAOs), particularly LAOs selected from C5-C14 alphaolefins, preferably from 1-hexene to 1-tetradecene, more preferably from 1-octene to 1-dodecene, and mixtures thereof, with 1-decene being the preferred material, although oligomers of lower olefins such as ethylene and propylene, oligomers of ethylene/butene-1 and isobutylenelbutene-1, and oligomers of ethylene with other higher olefins, as described in U.S. Pat. No. 4,956,122 and the patents referred to therein, and the like may also be used. PAOs offer superior volatility, thermal stability, and pour point characteristics to those base oils in Group I, II, and III.

Group V includes all the other base stocks not included in Groups I through IV. Group V base stocks includes the important group of lubricants based on or derived from esters. It also includes alkylated aromatics, polyinternal olefins (PIOs), polyalkylene glycols (PAGs), etc.

One of the great benefits of the present invention is that it is applicable to base oils fitting into any of the above five categories, API Groups I to V, as well as other materials, such as described below. As used herein, whenever the terminology "Group . . . " (followed by one or more of Roman Numerals I through V) is used, it refers to the API classification scheme set forth above.

It will be recognized that commercially-available hydrocarbon fluids also typically contain small amounts of heteroatom-containing species (e.g., oxygen, sulfur, nitrogen, and the like), typically on the order of less than 1 wt %, preferably less than 100 ppm. The contribution of sulfur, phosphorus, nitrogen from the base oil used in lubricant and other functional fluids are not considered in the calculation of S, P, and N ratios previously described.

Treat Rate in Base Oil

The treat rate of an additive package in base oil may be determined by one of ordinary skill in the art in possession of the present disclosure, taking into account the end use. While a specific treat rate is not critical to the characterization of the invention, for industrial gear oils, a preferred treat rate is about 1.0 to about 3.0 wt. %. This is based on the weight of the entire composition, including any optional additives added to the base oil that are not contributed by the additive package of the invention.

Such additional but optional ingredients that may be beneficial in the final lubricant or functional fluid composition that are not contemplated above for the additive package include pour point depressants, viscosity index modifiers, thickeners, and tackifiers.

The following examples are meant to illustrate the present invention in more detail and provide a comparison with other methods and the products produced therefrom. Numerous modifications and variations are possible and it is to be understood that within the scope of the appended claims, the invention may be practiced otherwise than as specifically described herein.

Industrial Gear Oils (IGOs)

Lubricating oil compositions A-E shown in Table 1 were prepared by adding a combination of additives to API Group I base oils to make an ISO VG 320 oil. The additives can be combined into an additive "package" first as described in an earlier section and then the package can be added to base oil of suitable viscosity, or alternatively, they can be added one by one to the base oil. The weight percentages of the key additives are shown for these five examples and the weight percentages of S, P, N, and triazole derivative are provided for these oils, along with the key ratios. The S-containing EP agents were either HPSIB or SIB. The HPSIB can be prepared from any of the high pressure methods described in an earlier section. The one used for these examples was Mobilad C-170, which typically possesses a sulfur content in the range of 45-50%. An HPSIB with a higher sulfur content can also be employed but as these are more aggressive towards yellow metals and elastomers and may contribute to gear surface corrosion, as discussed above, additives to counteract these effects might be required. The SIB used in the examples was Mobilad™ C-100 and can be prepared by using the sulfuryl monochloride process described in the patents listed earlier. Other SIBs may be used, such as Anglamol™ 33 and Hitec™ 312. The sulfur content of these SIBs is typically 43-50%. For the P-containing antiwear agents, a combination of Mobilad™ C-421 and Irgalube™ 349 were used. Nitrogen-containing primary tertiary amine, Primene™ 81R, a rust inhibitor, was used along with Mobilad™ C603, a rust inhibitor. Succinimide dispersants were added to some formulations, but were absent in others (as specified in the tables). The triazole derivative that was employed for this series of experiments was Cobratec™ TT100, a tolyltriazole, commercially available from PMC Specialties Group.

For comparison, oil compositions F-I in Table 2 were evaluated. Oils F and G were prepared with the same API Group I base stocks. The commercial oils are prepared from API Group I base stocks.

The performance of all nine oils were evaluated in the FE-8 Bearing Test, recently incorporated into the revised DIN specification DIN 51517-3. Also, several of these oils were further evaluated in the 3-phase FVA-54 Micropitting Test. Some of the oils were further evaluated in key bench tests, which are part of well-known industrial gear specifications.

TABLE 1

| | Examples | | | | | |
|---|---|---|---|---|---|---|
| | | Examples | | | | |
| | Requirements | A | B | C | D | E |
| Additives in Oil, wt % in finished oil | | | | | | |
| EP Agent - Mobilad C-170 | | 0.75 | 0.56 | 1.51 | | 0.56 |
| EP Agent - Mobilad C-100 | | | | | 0.56 | |
| Antiwear - Mobilad C-421 - Acid Phosphate | | 0.49 | 0.37 | 0.98 | 0.37 | 0.38 |
| Antiwear - Irgalube 349 - Aryl Phosphate | | 0.032 | 0.024 | 0.063 | 0.0079 | 0.0079 |
| Dispersants - TEPA Succinimides | | | 0.090 | 0.24 | | |
| Rust Inhibitor - Primene 81R | | 0.16 | 0.12 | 0.33 | 0.12 | 0.12 |
| Rust Inhibitor - Mobilad C-603 (Oxazolidone) | | 0.014 | 0.011 | 0.028 | 0.011 | 0.011 |
| Cobratec TT100 (Triazole Derivative) | | 0.011 | 0.0079 | 0.021 | 0.0026 | 0.0026 |
| Other Additives (defoamants, passivators, demulsifiers) | | balance | balance | balance | balance | balance |
| Additive Contributions, wt % in Finished Oil, and Ratios: | | | | | | |
| % S | | 0.37 | 0.27 | 0.74 | 0.27 | 0.27 |
| % P | | 0.057 | 0.044 | 0.12 | 0.043 | 0.044 |
| % S/% P | | 6.4 | 6.2 | 6.2 | 6.3 | 6.3 |
| % N | | 0.017 | 0.015 | 0.043 | 0.011 | 0.011 |
| % P/% N | | 3.3 | 3.0 | 2.7 | 3.8 | 3.8 |
| % S/% Triazole Derivative | | 35 | 35 | 35 | 103 | 105 |
| Test Results: | | | | | | |
| USS 224/AGMA 9005-E02 | | | | | | |
| Four Ball Wear, ASTM D2266, mm | ≦0.35 | 0.22 | 0.27 | 0.30 | nd | nd |
| Four Ball EP, ASTM D2783 | | | | | | |
| Load Wear Index, kg | ≧45 | 57.6 | 62.9 | 51.0 | nd | nd |
| Weld Point, kg | ≧250 | 315 | 250 | 250 | nd | nd |
| Oxidation Control, ASTM 2893 mod, % visc incr. | ≦6.0 | 4.9 | 5.4 | nd | nd | nd |

TABLE 1-continued

| | Requirements | Examples A | B | C | D | E |
|---|---|---|---|---|---|---|
| FZG Scuffing Test, ASTM D5182 | ≧12 | >12 | >12 | >12 | nd | nd |
| Timken, ASTM D2782, Pass Load | ≧60 | 70 | 65 | 75 | nd | nd |
| Rust Test, ASTM D665 | | | | | | |
| Parts A, B | Pass | Pass | Pass | Pass | Pass | nd |
| UZ,1/14 DIN 51517-3 and Micropitting | | | | | | |
| FVA-54 Micropitting, FLS* | ≧FLS 10 "High" | FLS 10 High | FLS 10 High | FLS 10 High | nd | nd |
| FE-8 Bearing Test, DIN 51819-3 | | | | | | |
| Roller Weight Loss, mg | ≦30 | 0.8 | 6.0 | 1.5 | 1.5 | 62 |

*FLS = Fail Load Stage

TABLE 2

| | Requirements | Comparative Examples F | G | H | I |
|---|---|---|---|---|---|
| Additives in Oil, wt % in Finished oil | | | | Commercial IGO | Commercial IGO |
| EP Agent - HPSIB (Mobilad C-170) | | 1.13 | 0.56 | | |
| Antiwear - Mobilad C-421 - Acid Phosphate | | 0.19 | 0.19 | | |
| Antiwear - Irgalube 349 - Aryl Phosphate | | 0.0079 | 0.0079 | | |
| Rust Inhibitor - Primene 81R | | 0.12 | 0.12 | | |
| Rust Inhibitor - Mobilad C-603 (Oxazolidone) | | 0.011 | 0.011 | | |
| Cobratec TT100 (Triazole Derivative) | | 0.0026 | 0.0026 | | |
| Other Additives (defoamants, passivators, demulsifiers) | | balance | balance | | |
| Additive Contributions, wt % in Finished Oil, and Ratios: | | | | | |
| % S | | 0.54 | 0.27 | 0.41 | 0.57 |
| % P | | 0.021 | 0.022 | 0.022 | 0.025 |
| % S/% P | | 25.6 | 12.6 | 18.8 | 22.7 |
| % N | | 0.011 | 0.011 | 0.014 | 0.050 |
| % P/% N | | 1.85 | 1.92 | 1.55 | 0.50 |
| % S/% Triazole Derivative | | 205 | 105 | nd | nd |
| Test Results: | | | | | |
| USS 224/AGMA 9005-E02 | | | | | |
| Four Ball Wear, ASTM D2266, mm | ≦0.35 | 0.34 | 0.28 | 0.29 | 0.31 |
| Four Ball EP, ASTM D2783 | | | | | |
| Load Wear Index, kg | ≧45 | 47.9 | 51.3 | 46.9 | 51.5 |
| Weld Point, kg | ≧250 | 250 | 200 | 250 | 200 |
| Oxidation Control, ASTM 2893 mod, % visc incr. | ≦6.0 | nd | 4.9 | 4.8 | 3.8 |
| FZG Scuffing Test, ASTM D5182 | ≧12 | >12 | >12 | >12 | >12 |
| Timken, ASTM D2782, Pass Load | ≧60 | 60 | nd | 65 | 80 |
| Rust Test, ASTM D665 | | | | | |
| Parts A, B | Pass | nd | nd | Pass | Pass |
| DIN 51517-3 and Micropitting | | | | | |
| FVA-54 Micropitting, FLS* | ≧FLS 10 "High" | FLS 9 Med | nd | FLS 8-9 Med | FLS 8-9 Med |
| FE-8 Bearing Test, DIN 51819-3 | | | | | |
| Roller Weight Loss, mg | ≦30 | 763 | 267.5 | 235 | 2.3 |

*FLS = Fail Load Stage

As is apparent from the results in Tables 1 and 2, the compositions having the best FE-8 and micropitting performance combined are those in Table 1, which possess a sulfur to phosphorus weight ratio of less than or equal to 10:1, a phosphorus to nitrogen ratio of greater than or equal to 2:1, and a sulfur to triazole derivative weight ratio of less than or equal to 150:1. When all three of these conditions are met, the bearing wear in the FE-8 is <30 mg, meeting the DIN 51517-3 specification. Example E is slightly over the 30 mg limit. If Examples D and E are compared, the key difference is the type of sulfur-containing EP agent. The slightly poorer performance of Example E would indicate that for some types of EP compounds, generally those of a more aggressive nature, a preferred embodiment of the invention would be a mass ratio of sulfur to triazole of <100:1, rather than <150:1. Three of the five examples described by this invention were also tested in the FVA Micropitting test. All reached the desired "high" protection from micropitting with a fail load stage (FLS) 10.

The comparative examples were chosen as they were outside of the scope of this invention. Example G is almost inside the scope of this invention but the S:P ratio is slightly higher and consequently FE-8 performance is poorer. Three of the four of these oils fail the FE-8 Bearing Test with triple digit wear. The commercial oil example I does provide excellent Bearing Wear test results but produces insufficient protection in the FVA-54 Micropitting Test. The other comparative examples tested also fail.

Some of the oils represented by Examples A-E were also tested in many of the standard IGO bench tests and were found to perform satisfactorily despite the reduced level of sulfur-containing EP agent relative to phosphorus-containing antiwear additive and despite the increased level of phosphorus-containing antiwear additive relative to nitrogen containing components (when compared with prior art commercial products). The comparative examples did not pass all the standard bench tests, e.g. the Timken Test and the Four Ball Extreme Pressure (EP) Test.

Thus, the invention has been described in detail with reference to numerous embodiments and specific examples. Many variations will suggest themselves to those skilled in this art in light of the description. All such obvious variations are within the full intended scope of the appended claims. Preferred embodiments include: a composition suitable for use as an additive system in a formulated lubricant, said composition comprising at least one sulfur-containing extreme pressure agent, at least one phosphorus-containing antiwear agent, and at least one triazole-containing species, said composition further characterized by having a mass ratio of sulfur to phosphorus of less than 10:1, a mass ratio of phosphorus to nitrogen of greater than 2:1, and a mass ratio of sulfur to triazole-containing corrosion inhibitor of no more than 150:1; and also more preferred embodiments selected from the following (which can be combined in numerous ways, as would be readily apparent to one of ordinary skill in the art in possession of the present disclosure): the composition further comprising at least one other nitrogen-containing compound, including especially wherein said at least one other nitrogen-containing compound is selected from rust inhibitors, dispersants, copper passivators, metal passivators, and antioxidants; the composition further comprising at least one other nitrogen-containing compound is selected from defoamants, demulsifiers, friction modifiers, seal swell agents, pour point depressants, diluents, thickeners, chromophores, tackifiers, or further comprising at least one other ingredient selected from rust inhibitors, dispersants, cleanliness agents, anti-foaming agents, metal corrosion prevention agents, demulsifiers, tackifiers, pour point depressants, VI improvers, chromophores, friction modifiers, deodorants, seal swell agents, and diluents; and/or further characterized by at least one of the properties selected from: (a) S:P≦8:1, (b) P:N≧2.5:1, and (c) S:triazole-containing ≦110:1, or further characterized by at least two of the properties selected from (a), (b), and (c), or further characterized by all three properties (a), (b), and (c); or in a still more preferred embodiment, the composition further characterized by at least one of the properties selected from: (a) S:P≦7:1, (b) P:N≧3:1, and (c) S: triazole-containing corrosion inhibitor ≦75:1, or further characterized by at least two of the properties selected from (a), (b), and (c), or further characterized by all three of the properties (a), (b), and (c); and/or the composition comprising at least one sulfur-containing extreme pressure agent selected from HPSIB extreme pressure agents, and/or comprising at least one phosphorus-containing antiwear agent selected from mono- and diaryl phosphates, and/or comprising at least one triazole-containing species selected from tolyltriazole and derivatives thereof; and also preferred embodiments described by: an industrial gear oil comprising the composition according to any of the aforementioned embodiments in combination with a basestock, especially wherein said basestock is selected from API Groups I-V and mixtures thereof; an automotive driveline fluid comprising the composition according to any one of the aforementioned compositions in combination with a basestock, especially wherein said basestock is selected from API Groups I-V and mixtures thereof; and even more preferably a manual transmission oil comprising the compositions set forth hereinabove comprising the additive system of the invention and basestock, especially a basestock selected from at least one API Group I-V basestocks; and also a yet still more preferable embodiment which is described in the nature of an improvement by the following: in a composition suitable for use as an additive system in a lubricating oil or functional fluid comprising a sulfur-containing extreme pressure agent, a phosphorus-containing antiwear component, and a nitrogen-containing component, the improvement comprising the presence of at least one triazole-containing species in a composition characterized by having a mass ratio of sulfur to phosphorus of less than 10:1, a mass ratio of phosphorus to nitrogen of greater than 2:1, and a mass ratio of sulfur to triazole-containing corrosion inhibitor of no more than 150:1; and also a composition suitable for use as an additive system in a lubricating oil, said composition made by a process comprising adding together at one sulfur-containing extreme pressure agent, a phosphorus-containing antiwear component, and at least one triazole-containing species so that said composition is characterized by having a mass ratio of sulfur to phosphorus of less than 10:1, a mass ratio of phosphorus to nitrogen of greater than 2:1, and a mass ratio of sulfur to triazole-containing corrosion inhibitor of no more than 150:1, especially wherein said process further comprising adding at least one basestock selected from API Groups I-V; and also a composition suitable for use as an additive system in a formulated lubricant oil, said composition obtainable by a process comprising adding together at one sulfur-containing extreme pressure agent, a phosphorus-containing antiwear component, and at least one triazole-containing species so that said composition is characterized by having a mass ratio of sulfur to phosphorus of less than 10:1, a mass ratio of phosphorus to nitrogen of greater than 2:1, and a mass ratio of sulfur to triazole-containing corrosion inhibitor of no more than 150:1, especially wherein said process further comprises adding at least one basestock selected from API Groups I-V; and also a contact product comprising at least one sulfur-containing extreme pressure agent, at least one phosphorus-containing antiwear agent, at least one triazole-containing species, said product further characterized by having a mass ratio of sulfur to phosphorus of less than 10:1, a mass ratio of phosphorus to nitrogen of greater than 2:1, and a mass ratio of sulfur to triazole-containing corrosion inhibitor of no more than 150:1 (or a product comprising contacting the ingredients so listed), and also said contact product further comprising (as an ingredient to be so contacted) at least one basestock selected from API Groups I-V; and also a method comprising contacting ingredients including at least one sulfur-containing extreme pressure agent, at least one phosphorus-containing antiwear agent, at least one triazole-containing species, to form a composition characterized by having a mass ratio of sulfur to phosphorus of less than 10:1, a mass ratio of phosphorus to nitrogen of greater than 2:1, and a mass ratio of sulfur to triazole-containing corrosion inhibitor of no more than 150:1, especially wherein said ingredients further comprise at least one basestock selected from API Groups I-V; and also the use of the additive system described herein in industrial gear oils and the use of an industrial gear oil comprising the additive system of the invention with industrial gears or any other use as a functional fluid (e.g., hydraulic fluid, carrier fluid, and the like).

Trade names used herein are indicated by a ™ symbol or ® symbol, indicating that the names may be protected by certain trademark rights, e.g., they may be registered trademarks in various jurisdictions.

All patents and patent applications, test procedures (such as ASTM methods, UL methods, and the like), and other documents cited herein are fully incorporated by reference to the extent such disclosure is not inconsistent with this invention and for all jurisdictions in which such incorporation is permitted.

When numerical lower limits and numerical upper limits are listed herein, ranges from any lower limit to any upper limit are contemplated. While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled in the art to which the invention pertains.

We claim:

1. A composition suitable for use as an additive system in a formulated lubricant, said composition comprising at least one sulfur-containing extreme pressure agent, at least one phosphorus-containing antiwear agent, and at least one triazole-containing species, said composition further characterized by having a mass ratio of sulfur to phosphorus of great than 1:1 and less than 10:1, a mass ratio of phosphorus to nitrogen of greater than 2:1 and less than 5:1, and a mass ratio of sulfur to triazole-containing corrosion inhibitor of greater than 10:1 and no more than 150:1.

2. The composition according to claim 1, further comprising at least one other nitrogen-containing compound.

3. The composition according to claim 2, wherein said at least one other nitrogen-containing compound is selected from rust inhibitors, dispersants, copper passivators, metal passivators, and antioxidants.

4. The composition according to claim 1, further comprising at least one other nitrogen-containing compound selected from defoamants, demulsifiers, friction modifiers, seal swell agents, pour point depressants, diluents, thickeners, chromophores, tackifiers.

5. The composition according to claim 1, further comprising at least one other ingredient selected from rust inhibitors, dispersants, cleanliness agents, anti-foaming agents, metal corrosion prevention agents, demulsifiers, tackifiers, pour point depressants, VI improvers, chromophores, friction modifiers, deodorants, seal swell agents, and diluents.

6. The composition according to claim 1, further characterized by at least one of the properties selected from: (a) S:P greater than 1:1 and less than or equal to 8:1, (b) P:N≧2.5:1 and less than 5:1, and (c) S:triazole-containing greater than 10:1 and less than or equal to 110:1.

7. The composition according to claim 6, further characterized by at least two of the properties selected from (a), (b), and (c).

8. The composition according to claim 6, further characterized by all three properties (a), (b), and (c).

9. The composition according to claim 1, further characterized by at least one of the properties selected from: (a) S:P greater than 1:1 and less than or equal to 7:1, (b) P:N≧3:1 and less than 5:1, and (c) S: triazole-containing corrosion inhibitor greater than 10:1 and less than or equal to 75:1.

10. The composition according to claim 9, further characterized by at least two of the properties selected from (a), (b), and (c).

11. The composition according to claim 9, further characterized by all three of the properties (a), (b), and (c).

12. The composition according to claim 1, comprising at least one sulfur-containing extreme pressure agent selected from HPSIB extreme pressure agents.

13. The composition according to claim 1, comprising at least one phosphorus-containing antiwear agent selected from mono- and diaryl phosphates.

14. The composition according to claim 1, comprising at least one triazole-containing species selected from tolyltriazole and derivatives thereof.

15. An industrial gear oil comprising the composition according to claim 1 and a basestock.

16. The industrial gear oil of claim 15, wherein said basestock is selected from API Groups I-V and mixtures thereof.

17. An automotive driveline fluid comprising the composition according to claim 1 and a basestock.

18. The automotive driveline fluid of claim 17, wherein said basestock is selected from API Groups I-V and mixtures thereof.

19. A manual transmission oil comprising the composition of claim 17.

20. In a composition suitable for use as an additive system in a lubricating oil or functional fluid comprising a sulfur-containing extreme pressure agent, a phosphorus-containing antiwear component, and a nitrogen-containing component, the improvement comprising the presence of at least one triazole-containing species in a composition characterized by having a mass ratio of sulfur to phosphorus of greater than 1:1 and less than 10:1, a mass ratio of phosphorus to nitrogen of greater than 2:1 and less than 5:1, and a mass ratio of sulfur to triazole-containing corrosion inhibitor of greater than 10:1 and no more than 150:1.

21. A composition suitable for use as an additive system in a lubricating oil, said composition made by a process comprising adding together at least one sulfur-containing extreme pressure agent, a phosphorus-containing antiwear component, and at least one triazole-containing species so that said composition is characterized by having a mass ratio of sulfur to phosphorus of greater than 1:1 and less than 10:1, a mass ratio of phosphorus to nitrogen of greater than 2:1 and less than 5:1, and a mass ratio of sulfur to triazole-containing corrosion inhibitor of greater than 10:1 and no more than 150:1.

22. The composition according to claim 21, wherein said process further comprising adding at least one basestock selected from API Groups I-V.

23. A composition suitable for use as an additive system in a formulated lubricant oil, said composition obtainable by a process comprising adding together at least one sulfur-containing extreme pressure agent, a phosphorus-containing antiwear component, and at least one triazole-containing species so that said composition is characterized by having a mass ratio of sulfur to phosphorus of greater than 1:1 and less than 10:1, a mass ratio of phosphorus to nitrogen of greater than 2:1 and less than 5:1, and a mass ratio of sulfur to triazole-containing corrosion inhibitor of greater than 10:1 and no more than 150:1.

24. The composition according to claim 23, said process further comprising adding at least one basestock selected from API Groups I-V.

25. A contact product comprising at least one sulfur-containing extreme pressure agent, at least one phosphorus-containing antiwear agent, at least one triazole-containing species, said product further characterized by having a mass ratio of sulfur to phosphorus of greater than 1:1 and less than 10:1, a mass ratio of phosphorus to nitrogen of greater than 2:1 and less than 5:1, and a mass ratio of sulfur to triazole-containing corrosion inhibitor grater than 10:1 and no more than 150:1.

26. The contact product of claim 25, further comprising at least one basestock selected from API Groups I-V.

27. A method comprising contacting ingredients including at least one sulfur-containing extreme pressure agent, at least one phosphorus-containing antiwear agent, at least one triazole-containing species, to form a composition characterized by having a mass ratio of sulfur to phosphorus of greater than 1:1 and less than 10:1, a mass ratio of phosphorus to nitrogen of greater than 2:1 and less than 5:1, and a mass ratio of sulfur to triazole-containing corrosion inhibitor of greater than 10:1 and no more than 150:1.

28. The method according to claim 27, wherein said ingredients further comprises at least one basestock selected from API Groups I-V.

* * * * *